US005313868A

United States Patent [19]

Wolf

[11] Patent Number: 5,313,868

[45] Date of Patent: May 24, 1994

[54] TRANSPORT PLATFORM AND MINE EXPLODER

[76] Inventor: Daniel Wolf, 4020 Hunnicutt St., San Diego, Calif. 92109

[21] Appl. No.: 970,306

[22] Filed: Nov. 2, 1992

[51] Int. Cl.[5] ..... F41H 11/12

[52] U.S. Cl. ..... 89/1.13; 102/402

[58] Field of Search ..... 89/1.13; 102/402

[56] References Cited

U.S. PATENT DOCUMENTS

| | | | |
|---|---|---|---|
| 1,190,257 | 7/1916 | Henderson | 89/1.13 |
| 1,278,382 | 9/1918 | Prendergast | 89/1.13 |
| 2,500,970 | 3/1950 | Walker | 89/1.13 |
| 3,771,413 | 11/1973 | Sieg et al. | 89/1.13 |
| 4,909,128 | 3/1990 | Grinwald | 89/1.13 |

*Primary Examiner*—David H. Brown
*Attorney, Agent, or Firm*—James F. Duffy

[57] ABSTRACT

A service platform for transport within an area wherein an explosive device is present. A remotely controlled tractor provides the primary motive force for moving the service platform through the explosion-prone area. Because of the danger personnel might experience in entering such an area, the tractor is remotely controlled by a transmitter manned by a person at a remote location. In situations where the explosive device comprises one or more mines hidden in the earth, the mobile support of the tractor will distribute the weight of the tractor over a sufficiently large ground surface area such that mines embedded in the ground will not have their firing circuitry triggered by passage of the tractor above the mine. However, the service platform is equipped with rugged, massive, ground contacting elements which are sufficiently light so as to not trigger the firing mechanism of anti-tank mines, but sufficiently massive to cause the firing of anti-personnel mines. The device is intended for use on pedestrian trails through forests and mountains and will find use in clearing mines from farm lands to be cultivated.

18 Claims, 3 Drawing Sheets

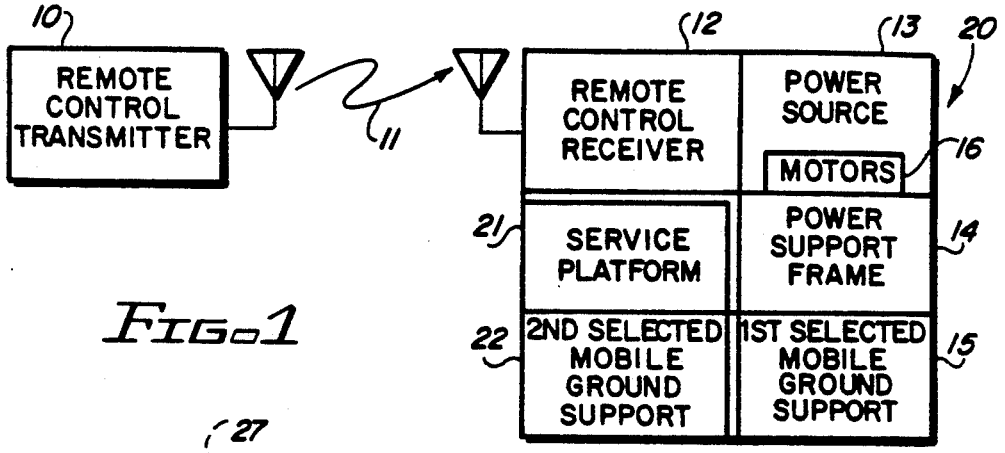
FIG. 1
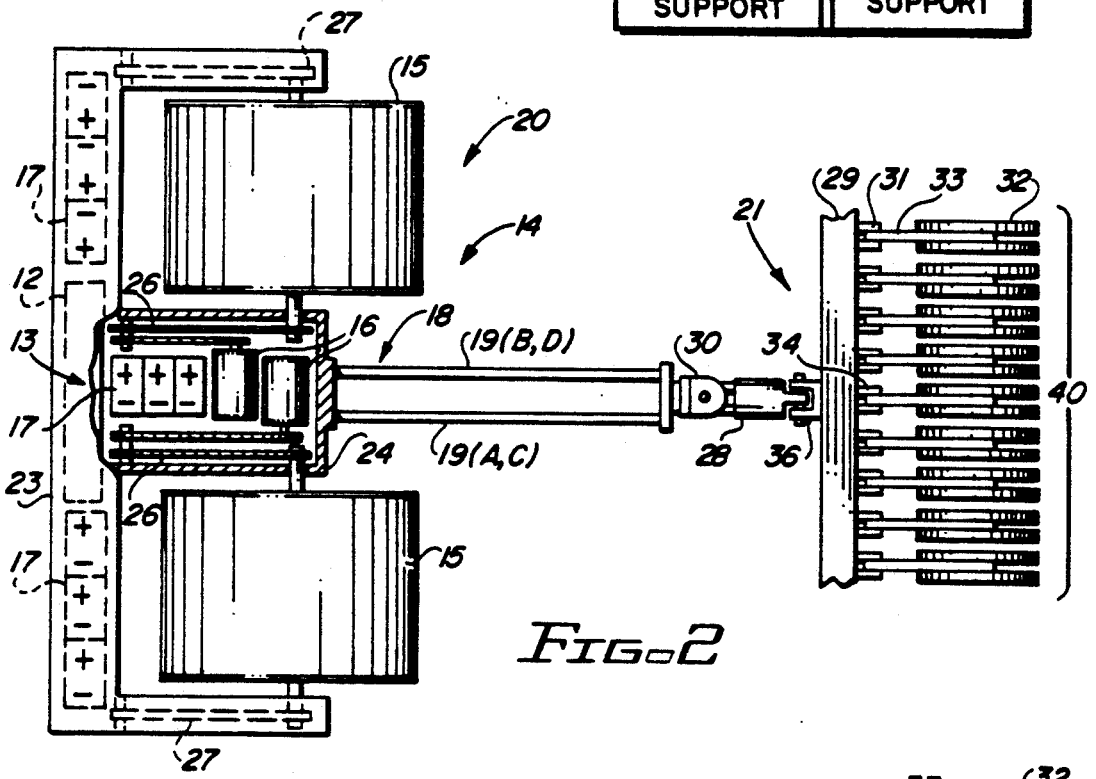
FIG. 2
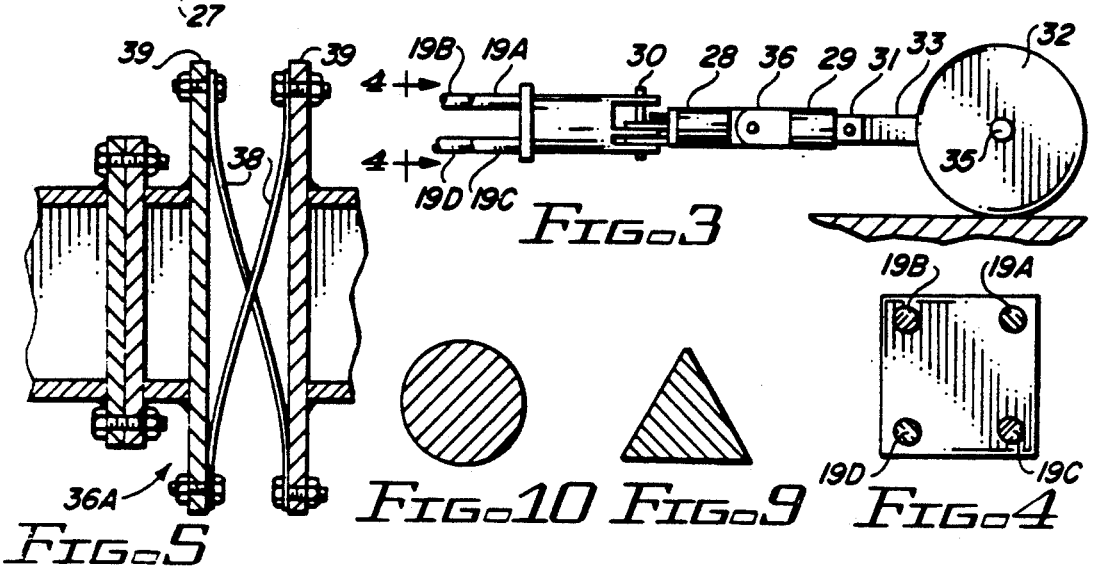
FIG. 3
FIG. 5
FIG. 10
FIG. 9
FIG. 4

TRANSPORT PLATFORM AND MINE EXPLODER

BACKGROUND

1. Technical Field of the Invention

The invention relates to remotely controlled, moving platforms. In particular, the invention relates to a remotely controlled, transport platform for use as an aid in transporting equipment and devices of bomb disposal squads for purposes of rendering explosives harmless.

2. Prior Background Art

Military and police bomb disposal squads make use of robotic manipulating devices, cameras and disposal equipment. Transport platforms for such devices are currently limited to travel on hard surfaces. A transport platform, highly maneuverable in all terrain situations, having a low center of gravity, would prove useful to bomb disposal squads. Satisfying the need for such a device is one of the intended uses for which the invention was derived.

Wars come and go as do the opposing armies and fighting factions. Yet, when wars and fighters are gone, death and destruction and the potential for further death and destruction remain on the pathways and the fields once trod by the opposing forces.

The reason death and destruction continue to lurk and to strike long after hostilities have ceased stems from the propensity of armed forces to seed explosive mines in the ground in places most likely to result in their being triggered by either pedestrian or vehicular traffic. Pathways through forests and wooded areas, open and cultivated fields; pathways through mountains from village to village, become the sites of sudden death and dismemberment. Population movement becomes stagnant. People are afraid to travel from one village to another. Whole populations are subjected to starving because the fields where they would normally grow their food now consume lives, or cripple those who enter.

There is little incentive for investment in programs aimed at removing mines in regions formerly subjected to hostilities. Mine detection devices are expensive. The work of mine removal is dangerous. Many mines, having plastic and wooden cases, are undetectable by conventional mine sensing equipment.

It is further intended that the instant invention be employed to move a mine exploding mechanism through areas containing anti-personnel and anti-tank mines. It is also intended that the mechanism transported by the invention will explode anti-personnel mines and leave the heavier, more difficult to trip, anti-tank mines to be weeded out by more conventional methods.

SUMMARY DESCRIPTION OF THE INVENTION

The invention is a tractor system. It has a frame and first, selected, mobile support means for supporting the frame and moving it over varied terrain. The first support means is selected to so distribute the weight of the tractor system over the surface of the terrain that ground pressure force concentrations created by passage of the first support means are generally insufficient in magnitude to trigger a mine disposed in the terrain. There are means coupled to the frame for transporting auxiliary equipment over the terrain.

The tractor system also includes driving means for driving the first mobile support means. The driving means comprises a source of motive power coupled to the first support means. It is protectively carried by the frame to shield it from shock and explosively impelled debris. There are control means for remotely controlling the operation of the driving means to remotely control the passage of the tractor system over the terrain.

The control means is protectively carried by the frame to shield the control means from shock and explosively compelled debris and the frame has a width generally selected to permit the tractor system to traverse pedestrian footpaths. The means coupled to the frame for transporting auxiliary equipment comprises coupling means for coupling a selected service platform to the frame. The service platform includes second, selected mobile support means for supporting the platform above the terrain. The second support means is selected to so concentrate the weight of the service platform on the surface of the terrain so as to explosively trigger a mine disposed in terrain over which the second support means passes. The service platform and the second support means are further structurally selected to survive exposure to a multiplicity of mine explosions. In a presently preferred embodiment, the second support means comprises a plurality of ground bearing supports having a ground contracting width selected to concentrate weight bearing pressure forces on terrain above a mine disposed in the terrain. Conversely, the first support means comprises a ground bearing mobile support mean having a ground contacting width selected to distribute weight bearing pressure forces on terrain above a mine disposed in the terrain so as to pass safely over the terrain and the mine free of explosive incident.

The invention may be further summarized as the combination comprising terrain to be traversed by pedestrian traffic and an explosive mine hidden within the terrain and subject to being explosively triggered by passage of pedestrian traffic on the terrain above the mine. There is a power driven tractor which has first selected mobile, ground support means for moving the tractor across the terrain above the mine. The first ground support means is selected to distribute the weight bearing pressure of the tractor over the surface of the terrain so that the tractor safely passes over the terrain above the mine, the mine remaining intact and armed. The combination includes a service platform having second selected, mobile ground support means. The service platform is coupled to the tractor for movement therewith. The second ground support means is selected to distribute weight bearing pressure on the surface of the terrain above the mine so as to trigger the mine to explode. The service platform and the second ground support means are structured and configured to survive the explosion of the mine.

BRIEF DESCRIPTION OF THE DRAWINGS

FIG. 1 is a functional block diagram of the transport platform and mine exploder of the invention.

FIG. 2 is a top, plan view of the invention showing the tractor which provides motive power and control and the service platform which is suitable for exploding anti-personnel mines.

FIG. 3 is a partial side elevation of the invention of FIG. 2.

FIG. 4 is an end view taken along lines 4—4 of FIG. 3 and showing the four torsion bars which form part of the central arm of the tractor in the illustration of FIG. 2.

FIG. 5 is a detail of an embodiment of a shock absorbing hinge arrangement.

FIG. 9 is a cross sectional view of the hitch pin taken along line 9—9 of FIG. 7.

FIG. 10 is a cross sectional view of the hitch pin taken along line 10—10 of FIG. 7.

DETAILS OF BEST MODE FOR CARRYING OUT THE INVENTION

Figure 6:
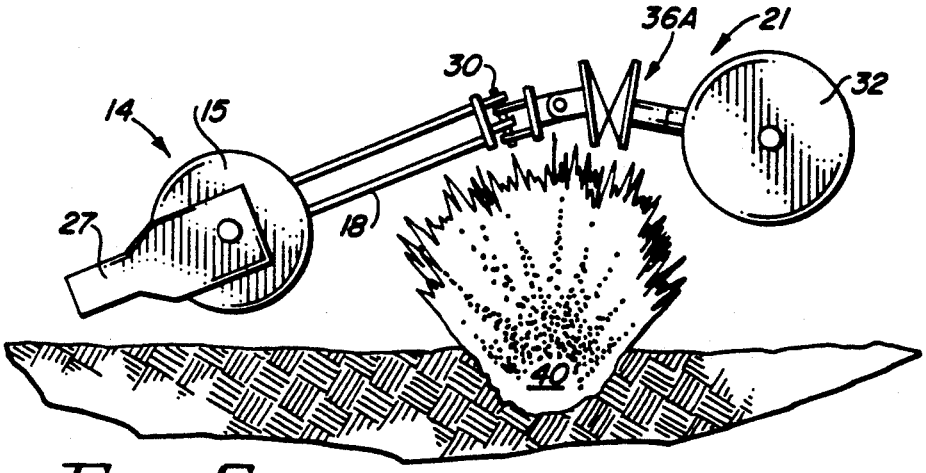
FIG. 6 shows the effect of the hinge arrangement of FIG. 5 in use on the invention after the invention has been subjected to the explosion of a land mine.

For purposes of promoting an understanding of the principles of the invention, reference will now be made to the embodiments illustrated in the drawings and specific language will be used to describe same. It will nevertheless be under stood that no limitation of the scope of the invention is thereby intended. Alterations and modifications of the illustrated device are contemplated, as are such further applications of the principles of the invention as would normally occur to one skilled in the art to which the invention pertains.

FIG. 1 is a generalized block diagram setting forth the functional aspects of the invention. Since the invention is intended for entry into areas where its arrival may be greeted by an explosive reaction, its movement is controlled by operation of remote control transmitter 10. Remote control transmitter 10 generates signals 11 which are conveyed to remote control receiver 12. The output of remote control receiver 12 establishes the operation of power source 13.

Power source 13 will contain, for example, an energy pack made up of batteries. Batteries with a non-liquid electrolyte are to be preferred. The power source will also contain the necessary drive motors 16 for providing the motive power to the invention.

Power source 13 is supported and protected by power support frame 14. Because the invention is intended for use in areas in which highly explosive devices may be detonated at any moment, power support frame 14 is designed to provide protective shielding and shock absorbent support for power source 13 and its elements. Because remote control receiver 12 will be particularly vulnerable to explosive shock, it too will be supported and protected by power support frame 14.

First, selected, mobile, ground support means 15 carries the weight of power support frame 14 and moves it over the ground. Since explosives may be found in any terrain: hard surfaced, overgrown, barren, said, marsh, etc. ground support means 15 is selected to provide optimal traction over a broad spectrum of terrain types.

Further, where the invention is intended to provide passage through mine-bearing terrain, ground support means 15 is selected to have a bearing surface on the ground which inhibits high concentrations of bearing pressure force on the ground traversed by support means 15. In these circumstances, support means 15 will be selected to have a "footprint" which is broad enough so that the pressure produced by it above the triggering mechanism of an anti-personnel mine is generally not sufficient to trigger that mine.

Drive motors 16, carried by power source 13, are coupled to ground support mass 15 to supply the motive impetus to support means 15 to move power support frame 14 over terrain in response to signals from remote control transmitter 10.

Remote control receiver 12, power source 13, support frame 14, and ground support means 15 constitute essential elements of a powered tractor 20. A service platform 21 is coupled to tractor 20. Service platform 21 is supported on second, selected mobile, ground support means 22. Ground support means 22 ease the passage of service platform 21 over terrain traversed by tractor 20, service platform 21 being coupled to tractor 20.

Service platform 21, in order to survive a hostile, explosive environment, is ruggedly constructed and includes curved or rounded surfaces to deflect explosively impelled debris and shrapnel. Ground support means 22 is selected to traverse the same type of terrain as that traversed by ground support 15 which supports and guides tractor 20. However, since the invention will often be utilized to explode anti-personnel mines, ground support means 22 is specifically selected to have a structural configuration which causes anti-personnel mines to explode and which survives the shock of such explosions. Two conceptual embodiments of the invention will now be considered.

In FIG. 2 is presented a first presently preferred embodiment of the invention in which power support frame 14 assumes a shape similar to the letter T. There is a central arm 18 which is comprised of a box-like arrangement of four torsion bars 19A–D. These torsion bars permit central arm 18 to twist under the impact of an explosive mine and to thereafter resume their shape and normal form function.

The upper cross arm 23 of T-shaped frame 14 houses remote control receiver 12 and battery power packs 17. Just below cross arm 23 of T-shaped frame 14 is an enlarged section 24 of central arm 18. This enlarged section houses an additional battery pack 17 as well as drive motors 16, one of each of which drives wheels, denoted as ground support means 15.

Motors 16 are drive coupled to the wheels of ground support means 15 by drive chains 26. Spring loaded, stress relieving, swing bars 27 absorb and expend the results of explosive shock transmitted to the ground support means 15 so as to prevent or minimize any damage.

The illustration of FIG. 2 shows the elements of power source 13 exposed for illustrative purposes. In practice, the elements of power source 13: remote control receiver 12, battery pack 17, and drive motors 16 will be protected by an enclosing covering not shown in the illustration of FIG. 2. Power support frame 14 is coupled to service platform 21 by means of tow bar 28. Tow bar 28 includes a shock absorbing hinge 36 and a tow bar cross member 29. Hitch 30 couples central arm 18 of power support frame 14 to the tow bar 28 of service platform 21. A series of pivotal couplings 31 line cross member 29. A first end of each disk support bar 33 is pivotally coupled to the couplings 31.

There is one exception to this arrangement, however. Bar 33, connected to coupling 34 on cross member 29, is not pivotal. Rather, at coupling 34, a bar 33 is fixedly coupled so as to support without pivoting a pair of disks 32. Each of the other bars 33 pivotally supports a pair of disks 32. Thus, as power support frame 14 moves over the terrain, service platform 21 is towed supported primarily by a pair of disks 32 rotatingly coupled to the disk support bar 33 which is fixedly coupled to cross member 29 at coupling 34. All of the other disks are free to pivot up and down as their support bars pivot about their pivotal couplings 31. This arrangement assures that there will be a full wide track at which pressure is brought to bear upon the surface of the terrain across the full width of the array 40 of disks 32.

The disk support bars 31 at each end of the array of disks 32 could be fixed in the coupling to cross member 29. Then, all disks 32 and disk support bars 33 between these outer-most couplings would remain pivotal. This arrangement, too, would allow all of the disks to come into contact with the ground despite variations in ground surface contours.

In the alternative, all disk support bars 33 may be fully pivotal such that cross bar 29 just skims along the ground.

Disks 32 are massive, reminiscent of bar bell disks in terms of shape and weight. The array 40 of the multiplicity of disks 32 assures that a wide swath of ground will be subjected to sufficiently high bearing pressure to cause the ignition of the firing circuit of any anti-personnel mine over which service platform 21 passes.

The disks 32 in the array of disks 40 are selected to have a mass which will, in combination with its adjacent disk supported upon the same disk support bar 33, cause the ignition of the firing circuit of an anti-personnel mine, but the mass will not be sufficient to cause the ignition in subsequent passage over an anti-tank mine.

It will be recalled that the footprint of the wheels of ground support means 15 were selected to spread their bearing pressure over a wide enough area so that there would be insufficient concentration of pressure forces anywhere below support 15 to cause the ignition of an anti-personnel mine. Thus, when the invention is guided by remote control across an area which has been mined, tractor 14 should safely traverse that part of the terrain in which an anti-personnel mine has been replaced. The diffusion of bearing pressures created by the large footprint of the wheels of ground support 15 so distribute the pressure that the mine will not ignited.

However when disks 32 of surface platform 21 pass over the same anti-personnel mine, the mass of any pair of wheels 32 passing over that mine will cause it to explode. The rugged construction of service platform 21 and its elements will result in no or minimal operating damages to service platform 21. In an actual test at a military facility, service platform 21 was lifted from the ground and rotated through an arc of at least 90 degrees. Torsion bars 19A–D absorbed the rotational forces without injury. When service platform 21 was set in its proper operating position on the ground, torsion bars 19A–D resumed their nominal working positions.

In practice service platform 21 will be as wide as power support frame 14.

The presence of a shock absorbing hinge 36 in tow bar 28 also aids in providing a shock absorbing reaction member to decrease the probability of damage occurring when disks 32 cause the ignition of an anti-personnel mine. As illustrated in FIGS. 2 and 3, hinge 36 is a simple pivotal pin coupling. Another embodiment of a shock absorbing hinge arrangement 36A is shown in FIGS. 5 and 6.

In FIG. 5 a detail, in side elevation, of the shock absorbing hinge coupling 36A is shown. It comprises a pair of mounting plates 39 which are coupled together by one or more pairs of high strength spring steel lever springs 38. The springs 38 are shown expanded in FIG. 5. In FIG. 6 a mine, originally positioned within the ground at 40, has exploded lifting both power support frame 14 and service platform 21 from the ground. The shock absorbing hinge coupling 36A has expanded thereby absorbing shock forces and reducing the probability of damage occurring elsewhere in the invention.

Figure 7:
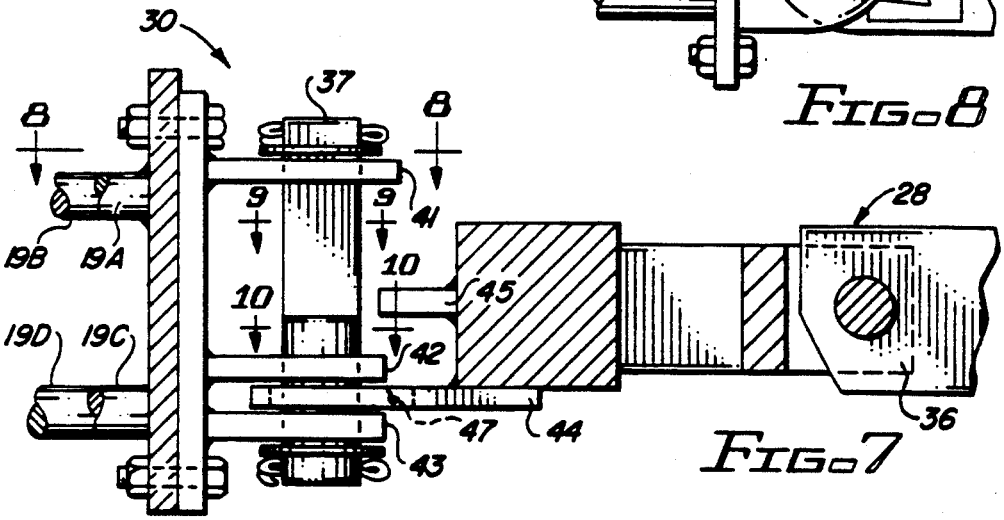
FIG. 7 is a side elevation showing the hitch employed to coupled the tractor and the service platform of FIG. 2.

As seen in the illustrations of FIGS. 2 and 3, service platform 21 is coupled to tractor 20 by means of hitch 30. Hitch 30 is unconventional in that it is capable of maintaining service platform 21 in a fixed in line position while tractor 20 is backing up. Hitch 30 comprises a hitch pin 37 and three hitch pin retainer plates 41–43 which are coupled to the torsion bars 19A–D of central arm 18 of frame 14. Hitch pin 37 has an upper cross section as depicted in FIG. 9 taken along line 9—9 of FIG. 7. The lower extremity of hitch pin 37 has a circular cross section as illustrated in FIG. 10 taken along line 10—10 of FIG. 7. Hitch pin retainer 41 has a bore through it which matches in configuration that of pin 37 as illustrated in FIG. 9. Similarly, hitch pin retainer plates 42 and 43 have bores which resemble the circular cross section of pin 37 shown in FIG. 10.

Figure 8:
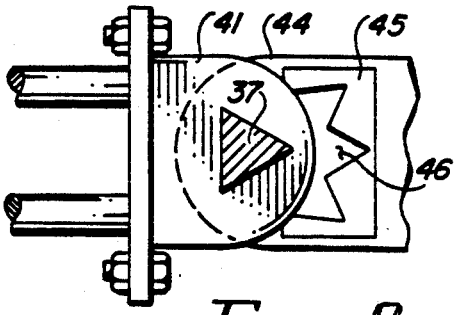
FIG. 8 is a top sectional plan view through line 8—8 of FIG. 7 showing the engagement plate for allowing the tractor to back while maintaining the service platform in line.

A top cross sectional view of hitch 30 taken along line 8—8 through hitch pin 37 is seen in FIG. 8. Hitch 30 includes the cooperative element 44 affixed to tow bar 28 of service platform 21. This is tow bar retainer plate 44 which has an elongated bore 47, shown in phantom outline in FIG. 7. When tractor 20 moves in reverse, hitch pin 37 moves relative to and within the elongated bore 47 toward tow bar 28. In doing so, hitch pin 37 will come into contact with alignment plate 45. Alignment plate 45 has one or more alignment notches 46, as illustrated in FIG. 8. As hitch pin 37 moves relative to alignment plate 45, it enters one of the notches 46 and is forced into locking engagement therewith by the continued rearward motion of tractor 20. With hitch pin 37 in locking engagement with notch 46, service platform 21 will remain at the angular disposition it was in when pin 37 engaged notch 46. Thus, tractor 20 may be placed in reverse without the necessity of continually maneuvering to maintain the service platform in line.

A second embodiment of the invention will now be disclosed in which the service platform advances before the tractor as the invention moves in the nominally forward direction.

Figure 11:
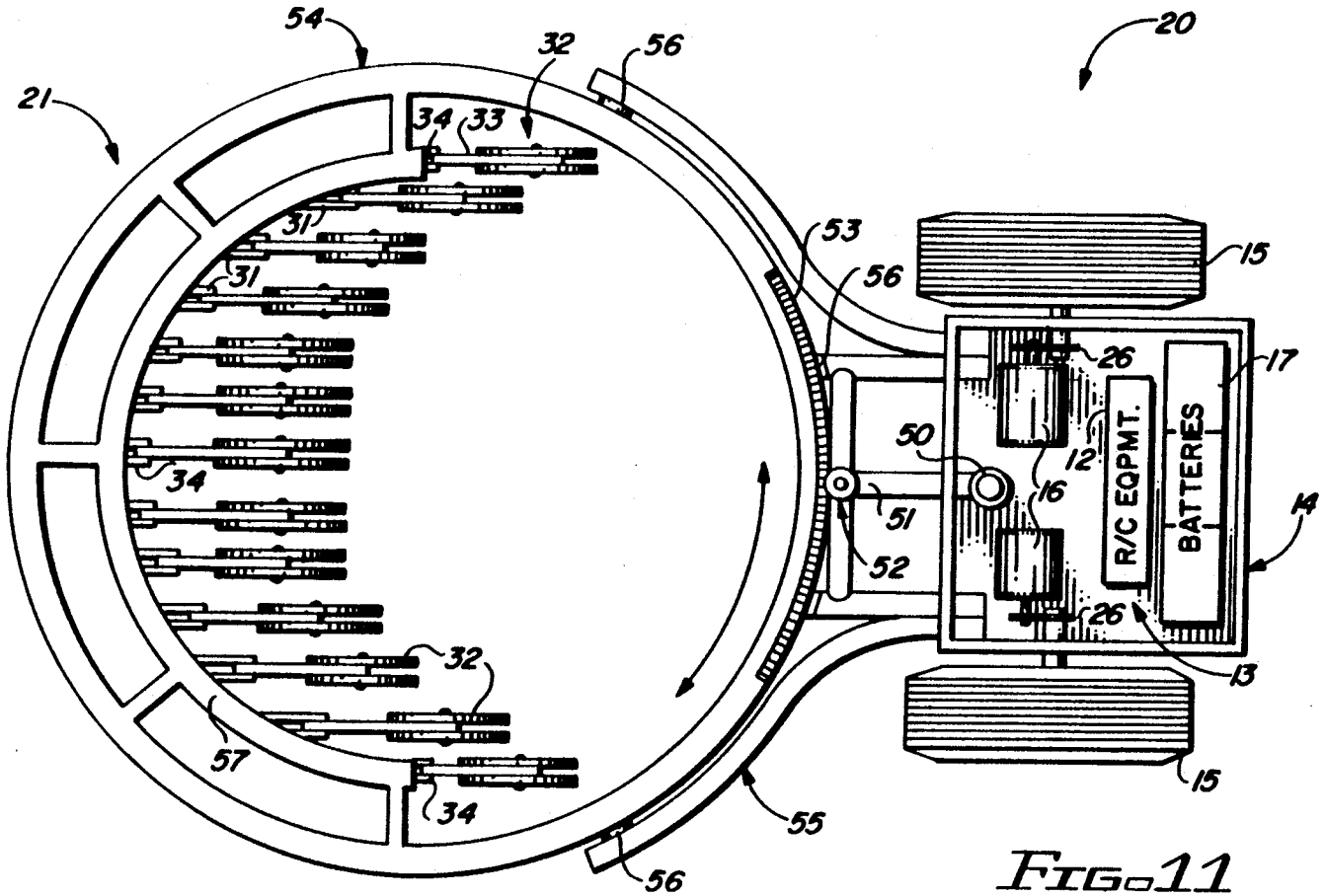
FIG. 11 is an alternative embodiment of the invention in which the tractor pushes the service platform and the mine exploding disk array is steerable.

In the alternate embodiment of the invention shown in FIG. 11, tractor 20 provides the prime motive force for moving service platform 21 into and through a potentially explosive area. Power support frame 14 houses batteries 17 and remote control receiver equipment 12. Drive motors 16 each individually drive a wheel which constitutes the ground support means 15. Included in this embodiment is a steering motor 50 which, like drive motors 16, is controlled by remote control equipment 12 in response to signals 11 transmitted from remote control transmitter 10.

The forward frame 55 of tractor 20 supports the circular frame 54 of service platform 21. Bearings 56 provide the means for movably coupling circular frame 54 of service platform 21 to the support frame 55 of tractor 20. The bearing couplings 56 permit circular frame 54 to rotate in the manner indicated by the double headed arrow within circular frame 54, as illustrated in FIG. 11.

Steering motor 50 is coupled by drive chain 51 to a pinion gear 52. Pinion Gear 52 meshes with the rack gear 53 at the outer periphery of circular frame 54.

In response to steering signals generated at remote control transmitter 10 and received by remote control equipment 12, steering motor 50 will cause the rotation of circular frame 54 so as to steer service platform 21 and tractor 20 in a desired direction.

Within circular frame 54 is disk support ring 57. Coupled to support ring 57 by means of support bars 33 are a plurality of disks 32. These disks 32 function in the same manner as the array 40 of disks in FIG. 2.

As in the embodiment of FIG. 2, disks 32 in FIG. 11 are generally pivotally coupled to support ring 57 at pivotal coupling points 31. However, selected coupling points, for example, coupling points 34, may be either fixed non-pivoting couplings or may be couplings of limited movement such that the disks 32, coupled by bar 33 to these points, may only rotate downwardly toward the ground away from circular frame 54.

Coupling points 34 thus limit the upward rotation of the disks 32 coupled to them and therefore provide the basic support for frame 54.

Figure 12:
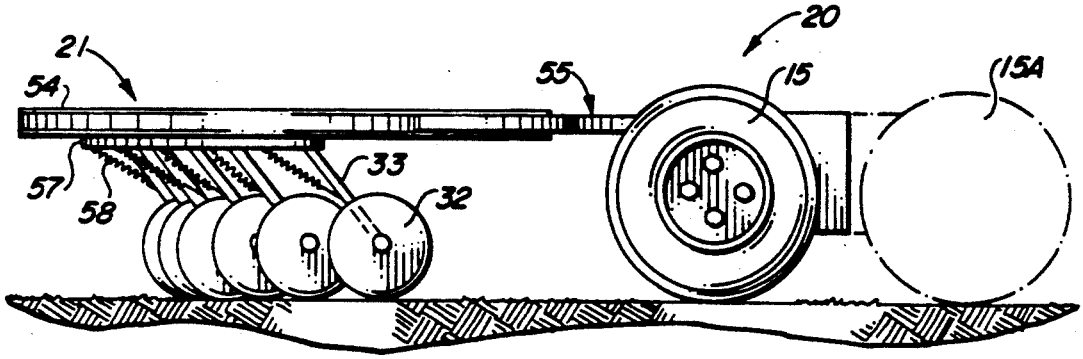
FIG. 12 is a side elevation of the alternate embodiment of FIG. 11.

On those disks which are coupled by bar 33 to pivotal coupling points 31, a downward moment may be created, drawing the disks downward from frame 54 toward the ground, by means of springs 58, as illustrated in FIG. 12.

As with the first embodiment earlier discussed, disks 32 provide sufficient mass in contact with the ground such that an anti-personnel mine will be ignited upon passage of disk 32 above the mine. However, the pressure created upon passage of disks 32 over the ground surface, will be generally insufficient to trigger anti-tank mines.

As the illustration in phantom outline in FIG. 12 suggests, additional ground support 15A may be provided if the invention requires that the weight of tractor 20 be spread over a large surface area of the ground or if additional traction is necessary.

What has been disclosed is a service platform for transport within an area wherein an explosive device is present. A remotely controlled tractor provides the primary motive force for moving the service platform through the explosion-prone area. Because of the danger personnel might experience in entering such an area, the tractor is remotely controlled by a transmitter manned by a person at a remote location. In situations where the explosive device comprises one or more mines hidden in the earth, the mobile support of the tractor will distribute the weight of the tractor over a sufficiently large ground surface area such that mines embedded in the ground will not have their firing circuitry triggered by passage of the tractor above the mine. However, the service platform is equipped with rugged, massive, ground contacting elements which are sufficiently light so as to not trigger the firing mechanism of anti-tank mines, but sufficiently massive to cause the firing of anti-personnel mines. The device is intended for use on pedestrian trails through forests and mountains and will find use in clearing mines from farm lands to be cultivated.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, That which is claimed is:

1. A tractor system for exploding anti-personnel mines comprising:

a frame; and first, selected, mobile support means for supporting said frame for movement over varied terrain;

said first support means being structured to create a broad ground contacting area to so distribute the weight of said tractor system over the surface of said terrain such that ground pressure force concentrations created by passage of said first support means are generally insufficient in magnitude to trigger an anti-personnel mine disposed in said terrain; and means coupled to said frame for transporting auxiliary equipment over said terrain for exploding said anti-personnel mine.

2. The tractor system of claim 1 wherein said frame has a width generally selected to permit said tractor system to transverse pedestrian footpaths.

3. The tractor system of claim 1 wherein said means coupled to said means for transporting auxiliary equipment includes coupling means.

4. The tractor system of claim 3 further comprising a selected service platform coupled to said coupling means, said service platform including second, selected mobile support means coupled to said service platform for supporting said platform above said terrain;

said second support means being structured to contact the ground as to so concentrate the weight of said service platform on the surface of said terrain so as to explosively trigger an anti-personnel mine disposed in terrain over which said second support means passes.

5. The tractor system of claim 4 wherein said frame and said service platform have a width generally selected to permit said tractor system to transverse pedestrian footpaths.

6. The tractor system of claim 4 wherein said second support means comprises a plurality of ground bearing supports having a ground contacting width selected to concentrate weight bearing pressure forces on terrain above an anti-personnel mine disposed in said terrain.

7. The tractor system of claim 4 wherein said service platform and said second support means have means configured to deflect explosively impelled debris and shrapnel and being deformable under explosive impact to distort and thereafter resume general shape and function.

8. The tractor system of claim 7 wherein said frame and said service platform have a width generally selected to permit said tractor system to traverse pedestrian footpaths.

9. The tractor system of claim 1 further comprising driving means for driving said first mobile support means, said driving means comprising a source of motive power coupled to said first support means and protectively carried by said frame said frame being structured to enclose said source of motive power to shield said source of motive power from shock and explosively impelled debris.

10. The tractor system of claim 9 wherein said frame has a width generally selected to permit said tractor system to traverse pedestrian footpaths.

11. The tractor system of claim 9 including control means in communication with a remote control device being coupled to said driving means for remotely controlling the operation of said driving means so as to remotely control the passage of said tractor system over said terrain.

12. The tractor system of claim 4 wherein said control means is protectively carried by said frame said frame being structured to enclose said control means to shield said control means from shock and explosively compelled debris and said frame has a width generally selected to permit said tractor system to traverse pedestrian footpaths.

13. The tractor system of claim 11 wherein said means coupled to said means for transporting auxiliary equipment includes coupling means.

14. The tractor system of claim 13 further comprising a selected service platform coupled to said coupling means, said service platform including second, selected mobile support means coupled to said service platform for supporting said platform above said terrain;

said second support means being structured to contact the ground to so concentrate the weight of said service platform on the surface of said terrain so as to explosively trigger an anti-personnel mine disposed in terrain over which said second support means passes.

15. The tractor system of claim 14 wherein said service platform and said second support means have means configured to deflect explosively impelled debris and shrapnel and being deformable under explosive impact to distort and thereafter resume general shape and function.

16. The tractor system of claim 15 wherein said control means is protectively carried by said frame said frame being structured to enclose said control means to shield said control means from shock and explosively impelled debris and said frame and said service platform have a width generally selected to permit said tractor system to traverse pedestrian footpaths.

17. The tractor system of claim 14 wherein said second support means comprises a plurality of ground bearing supports having a ground contacting width selected to concentrate weight bearing pressure forces on terrain above an anti-personnel mien disposed in said terrain.

18. The combination for exploding anti-personnel mines hidden in terrain to be traversed by pedestrian traffic, said combination comprising:

an explosive anti-personnel mine hidden within said terrain and subject to being explosively triggered by passage of pedestrian traffic on said terrain above said mine;

a power driven tractor having first selected mobile, ground support means for moving said tractor across said terrain above said anti-personnel mine;

said first ground support means being structured t create a broad ground contacting area to distribute the weight bearing pressure of said tractor over the surface of said terrain so that said tractor safely passes over said terrain above said anti-personnel mine, said mine remaining intact and armed;

a service platform having second selected, mobile ground support means, said service platform coupled to said tractor for movement therewith;

said second ground support means being massive relative to said first ground support means and structured to concentrate weight bearing pressure on the surface of said terrain above said anti-personnel mine so as to trigger said mine to explode;

said service platform and said second support means have means configured to deflect explosively impelled debris and shrapnel and being deformable under explosive impact to distort and thereafter resume general shape and function.

* * * * *